US006859947B2

(12) United States Patent
Lee

(10) Patent No.: US 6,859,947 B2
(45) Date of Patent: Mar. 1, 2005

(54) BUCKLE ASSEMBLY FOR ADJUSTING BAND FOR SWIMMING GOGGLES

(76) Inventor: Bom Kyu Lee, 107-1604 Hanshin Apt., 76 Yangpyung-dong 5-ga, Youngdeungpo-ku, Seoul (KR), 150-105

( * ) Notice: Subject to any disclaimer, the term of this patent is extended or adjusted under 35 U.S.C. 154(b) by 195 days.

(21) Appl. No.: 10/296,101

(22) PCT Filed: May 22, 2001

(86) PCT No.: PCT/KR01/00847

§ 371 (c)(1),
(2), (4) Date: Nov. 22, 2002

(87) PCT Pub. No.: WO01/89636

PCT Pub. Date: Nov. 29, 2001

(65) Prior Publication Data

US 2003/0182718 A1 Oct. 2, 2003

(30) Foreign Application Priority Data

May 23, 2000 (KR) ..... 2000-27617

(51) Int. Cl.[7] ..... A61F 9/02

(52) U.S. Cl. ..... 2/428; 2/452; 24/171; 24/196

(58) Field of Search ..... 2/428, 430, 452, 2/426, 440, 442, 450; 24/171, 194

(56) References Cited

U.S. PATENT DOCUMENTS

| | | | | |
|---|---|---|---|---|
| 1,374,896 A | | 4/1921 | Arnold | |
| 1,384,776 A | | 7/1921 | Posternock | |
| 3,300,825 A | | 1/1967 | Andreasen | |
| 3,349,449 A | | 10/1967 | Hatfield | |
| 4,527,292 A | | 7/1985 | Kasama et al. | 2/452 |
| 4,607,398 A | | 8/1986 | Faulconer | 2/452 |
| 5,181,280 A | | 1/1993 | Zachry, Jr. | 2/452 |
| 5,410,763 A | | 5/1995 | Bolle | 2/436 |
| 5,432,984 A | | 7/1995 | Petzl | 24/197 |
| 5,471,714 A | | 12/1995 | Olson | 24/171 |
| 5,657,493 A | | 8/1997 | Ferrero et al. | 2/428 |
| 5,706,526 A | * | 1/1998 | Huang | 2/428 |
| 5,727,259 A | | 3/1998 | Kawamata | 2/452 |
| 5,774,947 A | | 7/1998 | Anscher | 24/200 |
| 5,956,778 A | | 9/1999 | Godoy | 2/428 |
| 6,317,897 B1 | | 11/2001 | Chiang | 2/428 |
| 6,349,421 B2 | * | 2/2002 | Fukasawa et al. | 2/428 |
| 6,427,187 B2 | | 7/2002 | Malcolm | 711/119 |
| 6,446,272 B1 | * | 9/2002 | Lee | 2/428 |
| 6,505,352 B2 | * | 1/2003 | Chiang | 2/428 |

FOREIGN PATENT DOCUMENTS

WO WO 00 24477 5/2000

* cited by examiner

*Primary Examiner*—Katherine Moran
(74) *Attorney, Agent, or Firm*—Ohlandt, Greeley, Ruggiero & Perle, L.L.P.

(57) ABSTRACT

The invention is a buckle assembly for adjusting length of the band for swimming goggles comprising a buckle body formed with a band support portion onto which a flexible band having a plurality of stop members longitudinally disposed therealong are wound, and a slider connected to the buckle body for slidably moving between a first position and a second position for the band support portion. The slider comprises a band pressing piece which presses and holds the flexible band at a first position thereby one of the flexible band stop members is stopped by the band pressing piece and the slider is moved to a second position when the flexible band is extended by being pulled, and another of the flexible band stop members is stopped by the band pressing piece and the slider moves to a first position when the flexible band is contracted by being released from pulling.

5 Claims, 13 Drawing Sheets

BUCKLE ASSEMBLY FOR ADJUSTING BAND FOR SWIMMING GOGGLES

BACKGROUND OF THE INVENTION

1. Field of the Invention

The present invention relates to a buckle assembly for swimming goggles, and particularly to a buckle assembly for easy adjustments in length of the band for swimming goggles.

2. Description of the Related Art

Conventional swimming goggles 10 have band length adjusting pieces 17 which are formed on the ends of lens frames 12 as shown in FIG. 1. Such band length adjusting pieces 17 have at least two long through-holes, through which ends of flexible band 15 are passed. These through-holes are located in parallel as shown in FIG. 2. Band 15 is wound on a band support portion 17*a* between two through-holes. In order to easily adjust the band with the band length adjusting pieces 17 for adjusting length, the center portion of outermost side band support portion 17*b* is partially cut. Free end 15*a* is first passed from the back side through the through-holes adjacent to lens frame of band length adjusting piece 17, by passing the free end 15*a* through the outermost side through-hole. Then, the band 15 is situated into band length adjusting pieces 17.

Generally, swimming goggles 10 comprise two lens frames 12 into which lenses are adapted, and a nose-bridge 14 connecting the lens frames at the midline of the swimming goggles. Flexible band 15 connects the two length adjusting pieces 17 at the lateral ends of the respective lens frames 12. Protective pads 13 are installed on the inside surface of each lens frame. Protective pads 13 are adapted to closely contact the outer circumference of each user's eyes by their compressibility.

Before wearing the swimming goggles 10, a user adjusts the length of the flexible band by pulling a portion of the flexible band wound around band support portion 17*a*. Once worn, protective pads 13 press upon the outer circumference skin of a user's eyes in a water tight manner such that intrusion of water into the lens frames is avoided. If the flexible band is adjusted to excessive pressure, protective pads 13 assert strong pressure on the circumference skin of the eyes and causes a pain on the epidermal contact points. On the other hand, if the flexible band is too loosely adjusted, water enters into the lens frames past protective pads 13. Therefore, it is necessary for the flexible band to be adjusted to match with the circumference of a user's head such that appropriate pressure is exerted upon the user's face without water intrusion into the lens frames.

In order to precisely adjust the length of the flexible band to match with the circumference of a user's head, it is necessary for the user to adjust the length of the flexible band while wearing the swimming goggles on the user's head. In swimming goggles having conventional buckle assemblies, it is near impossible for a user to adjust the length of the flexible band while wearing the swimming goggles. As such, the problem in the prior art is that a user can only make adjustments to the length of the band with both hands and with the goggles removed from the user's head. After adjustment, the swimming goggles have to be put back on and repeatedly removed, adjusted and placed back on the head in a trial by error manner until the length of flexible band is adjusted to the appropriate length.

The present invention solves the above identified problems in the art with the following disclosure.

SUMMARY OF THE INVENTION

It is an object of the present invention to provide a buckle assembly that allows a user to easily and quickly adjust the length of the band with one hand while wearing the swimming goggles.

One aspect of the present invention is a buckle assembly comprising a buckle body formed with a band support portion onto which a flexible band having a plurality of stop members longitudinally disposed along said band, is wound. The buckle body further comprises a slider connected to the buckle body for slidably moving between a first position and a second position against the band support portion. The slider has a band pressing piece which presses and holds the flexible band at the first position, thereby one of the flexible band stop members is stopped against the band pressing piece and the slider is then moved to the second position when the flexible band is extended by being pulled, and another of the flexible band stop members is stopped by the band pressing piece and the slider is moved to the first position when the flexible band is contracted by pulling bias being released.

The buckle body comprises a rectangular frame having a first side and a second side which are parallel with each other, and a third side and a fourth side which are parallel with each other. The buckle body further comprises first stoppers formed on the first side of the rectangular frame to set a first position of the slider, and a second stopper formed on the second side of the rectangular frame to set the second position of the slider. The slider comprises a pair of hook pieces which are slidably connected to the buckle body on the third and fourth sides and stopped at the first position and the second position by the first stopper and the second stopper, respectively.

According to the another aspect, the swimming goggles of the present invention comprises a pair of lens frames including lenses, a flexible band having a plurality of stop members longitudinally disposed along the band, and a buckle assembly combining the lens frame and the flexible band. The buckle body is integrally formed with the lens frame.

According to yet another aspect, the swimming goggles of the present invention comprises a pair of lens frames including lenses, a flexible band having a plurality of stop members longitudinally disposed along said band, and a buckle assembly combining the lens frame and the flexible band. This aspect further comprises a connecting member for connecting the lens frame formed in a first side of the buckle body of the buckle assembly, and an aperture accommodating the connecting member of the buckle assembly formed in an outer surface of the lens frame.

According to another aspect, a buckle assembly of the present invention comprises a buckle body formed with first and second band support portions onto which first and second flexible bands which respectively have a plurality of stop members longitudinally disposed along said band, are wound. This buckle assembly further comprises first and second sliders connected to the buckle body for slidably moving between a first position and a second position respectively with respect to the first and second band support portions, first and second sliders having first and second band pressing pieces which press and hold the first and second flexible bands against the first and second band support portions at the first position, thereby one of the first flexible band stop members being stopped by the first band pressing piece and the first slider being moved to the second position when the first flexible band is extended by being pulled. Another of the first flexible band stop members is stopped by the first band pressing piece and the first slider being moved to the first position when the first flexible band is contracted by bias being released from pulling. One of the second flexible band stop members is stopped by the second band pressing piece and the second slider is moved to the second position when the second flexible band is extended by being pulled, and another of the second flexible band stop members is stopped by the second band pressing piece and the second slider moves to the first position when the second flexible band is contracted by bias being released from pulling. The buckle body comprises a rectangular frame having a first side and a second side which are parallel with each other, and also a third side and a fourth side which are parallel with each other. The buckle body further comprises a first stopper formed on the center of the third and fourth sides of the rectangular frame to set the first position of the first and second sliders, and second stoppers formed on the center of the first and second sides of the rectangular frame to set the second position of the first and second sliders. The first and second sliders comprise a pair of first and second hook portions which are slidably connected to the buckle body on the third and fourth sides and stopped at the respective first and second positions of the buckle body by the first stopper and the second stopper, respectively.

The buckle assembly of the present invention can also comprise first and second buckle bodies formed with first and second band support portions onto which first and second flexible bands which respectively have a plurality of stop members longitudinally disposed along the band, are wound. The buckle assembly further comprises first and second sliders connected to the first and second buckle bodies for slidably moving between a first position and a second position respectively with respect to the first and second band support portions. The first and second sliders have first and second band pressing pieces which press and hold the first and second flexible bands against the first and second band support portions at the first position. Thereby one of the first flexible band stop members is stopped by the first band pressing piece and the first slider is moved to the second position when the first flexible band is extended by being pulled, and another of the first flexible band stop members is stopped by the first band pressing piece and the first slider is moved to the first position when the first flexible band is contracted by being released from pulling bias. One of the second flexible band stop members is then stopped by the second band pressing piece and the second slider is moved to the second position when the second flexible band is extended by being pulled, and another of the second flexible band stop members is stopped by the second band pressing piece and the second slider being is moved to the first position when the second flexible band is contracted by being released from pulling bias. The first and second buckle bodies comprise a rectangular frame having a first side and a second side which are parallel with each other, and also a third side and a fourth side which are parallel with each other. First stoppers are formed on the first side of the rectangular frame to set the first position of the first and second sliders, and a second stopper is formed on the second side of the rectangular frame to set the second position of the first and second sliders. The first and second sliders comprise a pair of first and second hook portions which are slidably connected to the first and second buckle bodies on the third and fourth sides and stopped at the respective first position and second position of the first and second buckle bodies by the first stopper and the second stopper, respectively. They form the first and second connecting members in the first side for each first and second buckle bodies, respectively, and further comprise a connector which receives the first and second connecting members of the first and second buckle bodies.

BRIEF DESCRIPTION OF THE DRAWINGS

FIG. 7A shows the "fixed condition" of the buckle assembly after adjusting a length of the flexible band, and FIG. 7B shows the "released condition" allowing adjustment of the length of the band.

FIG. 8A shows the first position of the slider, and FIG. 8B shows a second position of the slider.

FIG. 13A shows the fixed condition of the buckle assembly after adjusting a length of the flexible band, and FIG. 13B shows the released condition allowing adjustment of the length of the band.

FIG. 14A shows the first position of the slider, and FIG. 14B shows the second position of the slider.

DETAILED DESCRIPTION OF PREFERRED EMBODIMENTS

The present invention will now be described in detail with reference to the accompanying drawings. In particular, the buckle assembly is described with reference to the following specific embodiments which are used with swimming goggles. However, it will be apparent to those skilled in the art that the buckle assembly of the present invention can be adapted for use with any equivalent application wherein a band means whose length needs adjustment otherwise by repetitious pulling and release actions is required.

First Embodiment

Figure 1:
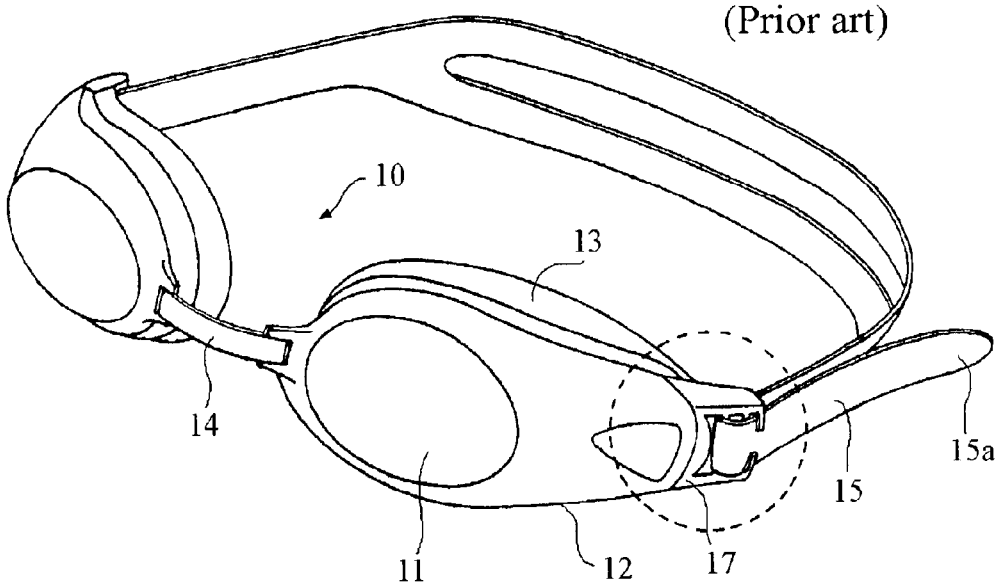
Fig. 1 (Prior art)
FIG. 1 is an elevated perspective view depicting a prior art swimming goggles with a prior art band length adjusting piece.
Figure 2:
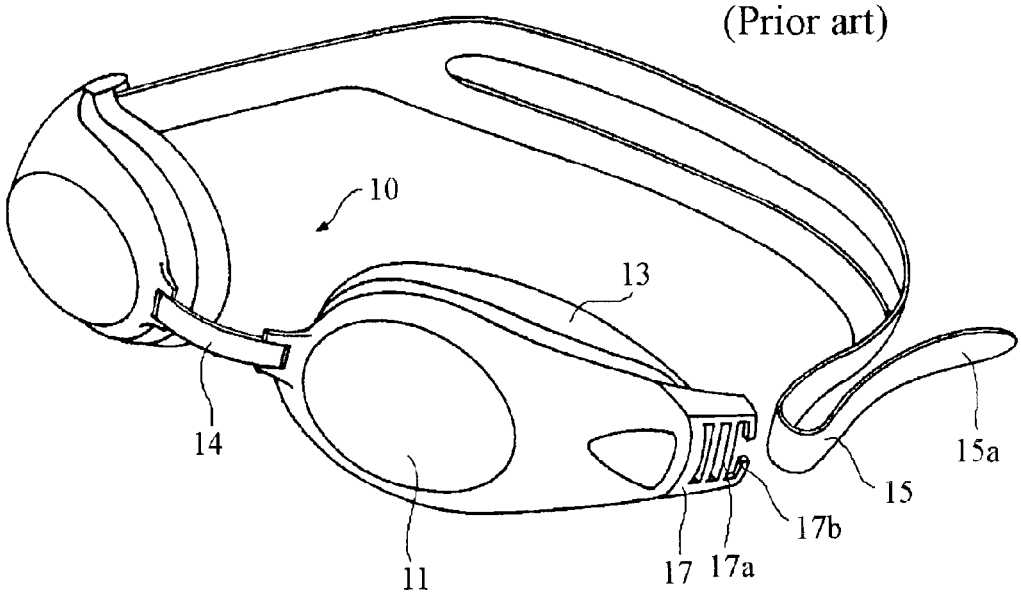
Fig. 2 (Prior art)
FIG. 2 is an elevated perspective view of the prior art swimming goggles shown in FIG. 1, with one end of the band separated from the end's respective band length-adjusting piece.
Figure 3:
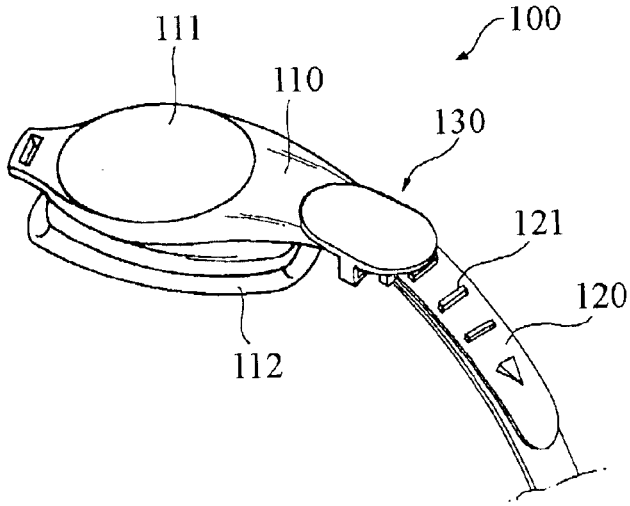
FIG. 3 is an elevated perspective view of one lens frame of the swimming goggles in accordance with first embodiment of the present invention with a partial view of the band.
Figure 4:
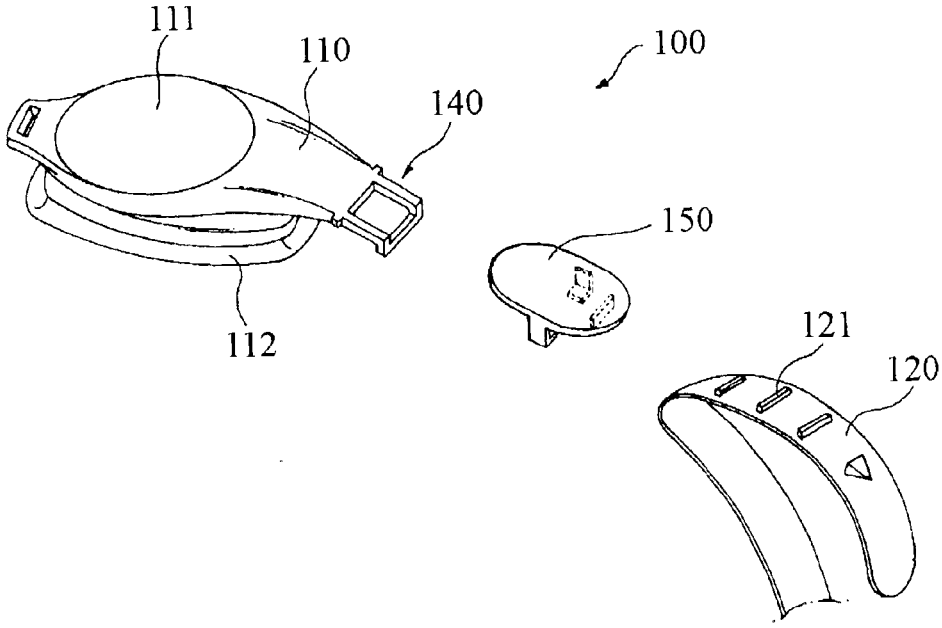
FIG. 4 is an exploded perspective view showing the components for the portion of the swimming goggles shown in FIG. 3.

FIG. 3 and FIG. 4 are a partial perspective view and an exploded perspective view showing the swimming goggles having a buckle assembly in accordance with first embodiment of the present invention.

Only the relevant and exemplary one-half portions of the swimming goggles are shown. The swimming goggles comprise a lens frame 110 in which lens 111 is formed, a flexible band 120 having a plurality of stop members 121 and a buckle assembly 130 which connects lens frame 110 to flexible band 120. Protective pad 112 are installed on the back of lens frame 110. One skilled in the art will appreciate that the same structure is repeated in the other half to make a whole swimming goggles. FIG. 4 is an exploded perspective view showing the components of the apparatus shown in FIG. 3. Lens frame 110 has at its lateral end, an integrally formed buckle body 140. Thus, the buckle assembly 130 shown in FIG. 3 is comprised of buckle body 140 and slider 150 as depicted in FIG. 4.

Figure 5:
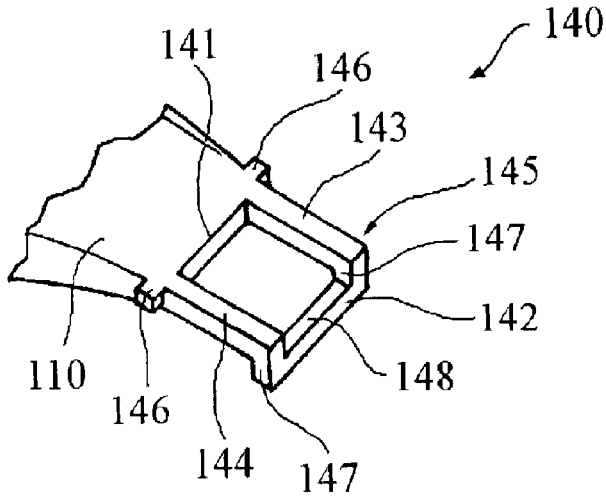
FIG. 5 shows details of the buckle body of the buckle assembly shown in FIG. 3.

According to the first embodiment shown in FIG. 5, buckle body 140 comprises a rectangular frame 145 comprised of a first side 141 and a second side 142 which are parallel with each other, and a third side 143 and a fourth side 144 which are parallel with each other. First stoppers 146 are integrally formed and protrude from first side 141 of rectangular frame 145. First stoppers 146 are projection shapes coaxially extending from first side 141. The second side 142 of rectangular frame 145 comprises band support portion 148 and second stoppers 147. Second stoppers 147 are at either ends of second side 142 and extend perpendicularly from the second side and are connected by the band support portion 148.

Band support portion 148 is adapted to have a flexible band wrapped around thereon. One skilled in the art will appreciate that first stoppers 146 may be formed in a perpendicular orientation to first side 141, and band support portion 148 may be formed in the plain of second side 142 such that second stoppers 147 are not perpendicular to second side 142.

Figure 6:
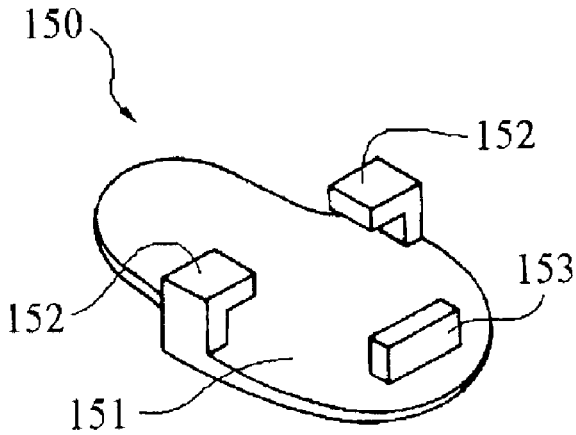
FIG. 6 is an elevated perspective view of the base of a slider of the buckle assembly shown in FIG. 3.

FIG. 6 shows that slider 150 has a pair of L-shaped hook pieces 152 and a band-pressing piece 153 which extend perpendicularly from the lower surface of slider body 151. Each hook piece 152 is bent inwardly after extending perpendicularly from the lower surface of slider body 151, and are adapted to engage third side 143 and fourth side 144 of rectangular frame 145. Hook pieces 152 allow slider 150 to slidably engage buckle body 140 adjacent third side 143 and fourth side 144. Band-pressing piece 153 is adapted to press and hold a flexible band against the band support portion 148.

Figure 7A:
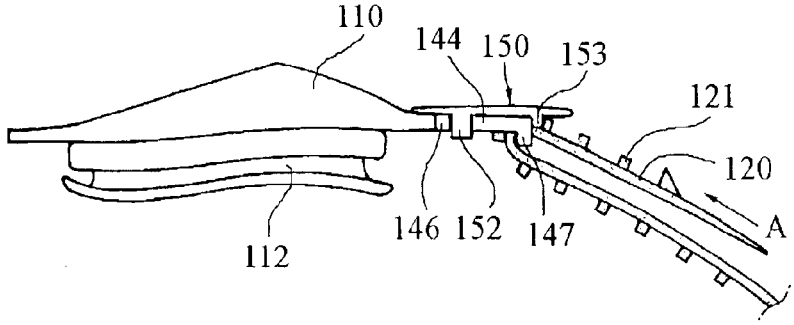
FIGS. 7A and 7B are side views of the portion of the swimming goggles as in FIG. 3, depicting the operation of the buckle assembly.
Figure 7B:
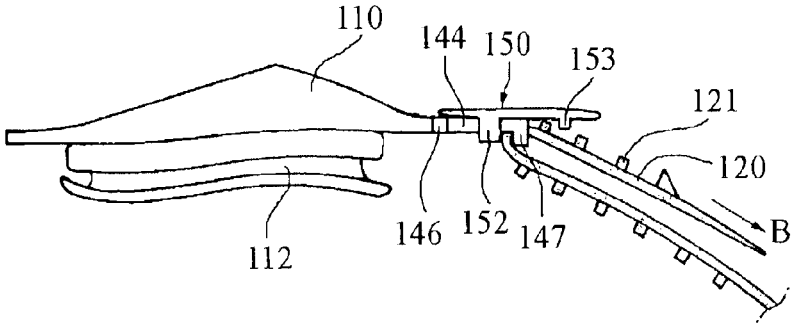

FIGS. 7A and 7B are side views of the first embodiment swimming goggles. FIG. 7A shows the fixed position of the buckle assembly after adjusting the length of a flexible band 120, and FIG. 7B shows the released condition allowing for adjustment in the length of the band.

First the situation in which a user adjusts the length of flexible band 120 after the swimming goggles is already on the user's head in a loose condition is detailed. In a loose condition, the length of available flexible band is greater than the circumferential length of the user's head. When the user pulls the band end with one hand in the condition of FIG. 7A, one of the stop members 121 of the flexible band 120 abuts band pressing piece 153 when the flexible band is extended in the direction of arrow "B" (see FIG. 7B). Thereby, slider 150 is moved in direction B as shown in FIG. 7B. As slider 150 is moved in direction B, band pressing piece 153 which is normally biased by flexible band 120 at a stop member 121, releases the biasing hold on flexible band 120, and the length of the flexible band can be adjusted.

After the user adjusts the length of flexible band 120, the pull in direction B is released, and the next stop member 121 of the flexible band is biased against band pressing piece 153 as flexible band 120 contracts in the direction of arrow "A" as shown in FIG. 7A. Thereby, slider 150 moves in direction A. As slider 150 is moved in direction A, band-pressing piece 153 holds flexible band 120 in a biased and adjusted condition.

Figure 8A:
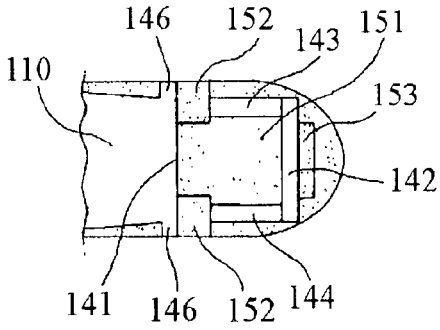
FIGS. 8A and 8B are bottom views showing the relative displacement of the slider for the buckle body of the buckle assembly shown in FIG. 3.
Figure 8B:
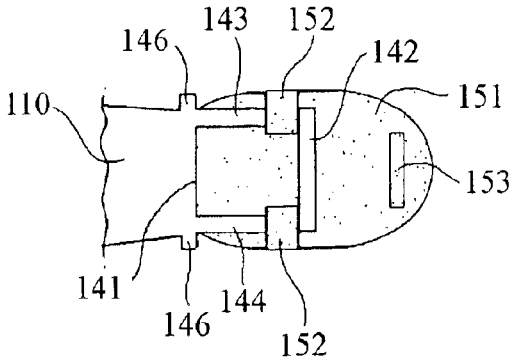

FIGS. 8A and 8B are bottom views showing the relative displacement of the slider about the buckle body of the buckle assembly on which a band is not wound. FIG. 8A shows that first stoppers 146 of buckle body 140 stop the movement of slider 150 when hook pieces 152 of slider 150 are flush against first stoppers 146 when flexible band 120 is in rest and in direction A as shown in FIG. 7A and second stoppers 147 come to rest on band support portion 153. When flexible band 120 is moved in direction B as shown in FIG. 7A, hook pieces 152 of slider 150 come in contact with the flexible band. Even without the flexible band 120, FIG. 8B shows that the movement of slider 150 is stopped when hook pieces 152 of slider 150 come in contact with second side 142 of the rectangular frame 145 of buckle body 140. Thus, even if flexible band 120 is pulled or when it is released, slider 150 does not disengage from the buckle body 140.

Figure 9:
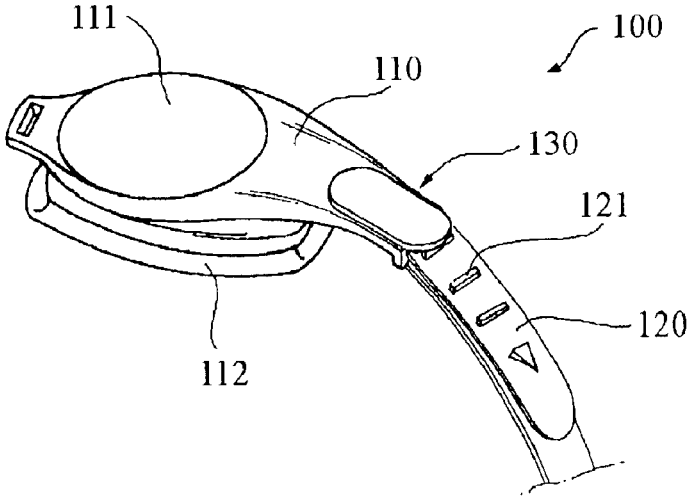
FIG. 9 shows a variation to the first embodiment of the buckle assembly of the present invention.
Figure 10:
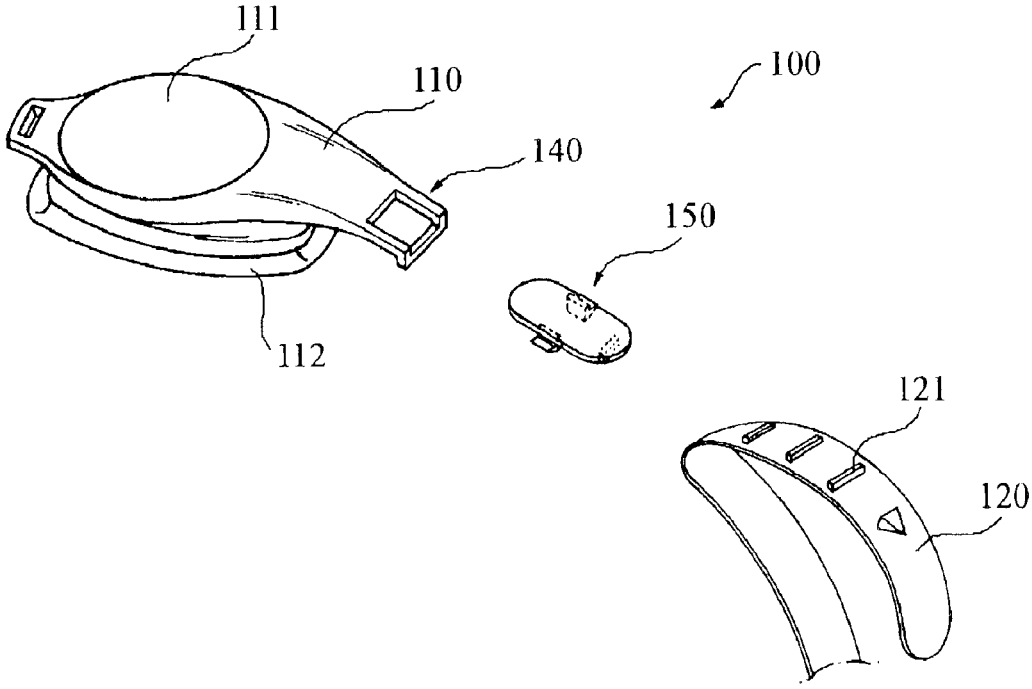
FIG. 10 is an exploded perspective view showing the components for the portion of the swimming goggles shown in FIG. 9.
Figure 11:
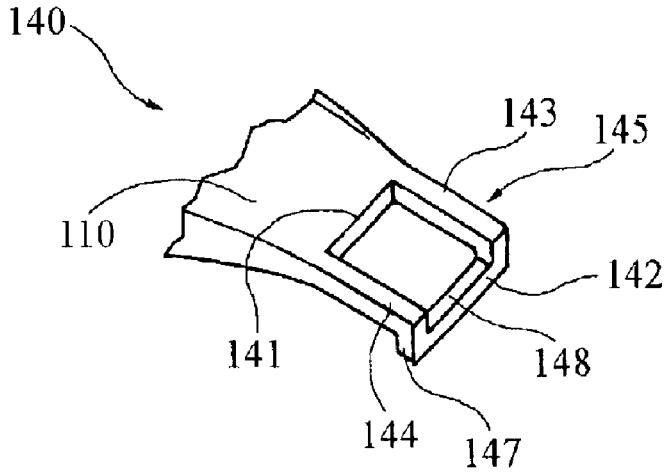
FIG. 11 shows details of the buckle body of the buckle assembly shown in FIG. 9.

FIGS. 9 to 14B show a variant of the first embodiment shown and described with reference to FIG. 3. The buckle assembly of FIG. 9 is different from the buckle assembly of FIG. 3 in the configuration of the hook pieces of the slider and first stopper of the buckle body. In the slider 150 of FIG. 6, after the hook pieces 152 are vertically extended from both edges of slider body 151, the end portions of the hook pieces 152 are bent inwardly in an L-shape. In the slider 150 of FIG. 12, hook pieces 152' have end portions which bend outwardly and in a configuration opposite to the hook pieces 152 of the slider shown in FIG. 6.

Figure 12:
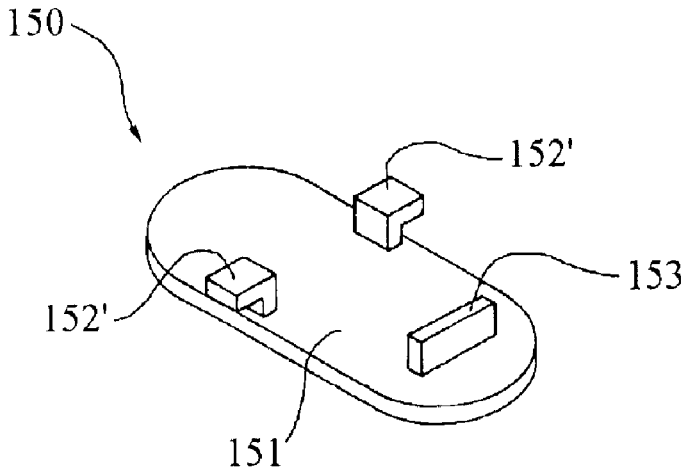
FIG. 12 is an elevated perspective view of the base of a slider of the buckle assembly shown in FIG. 9.
Figure 13A:
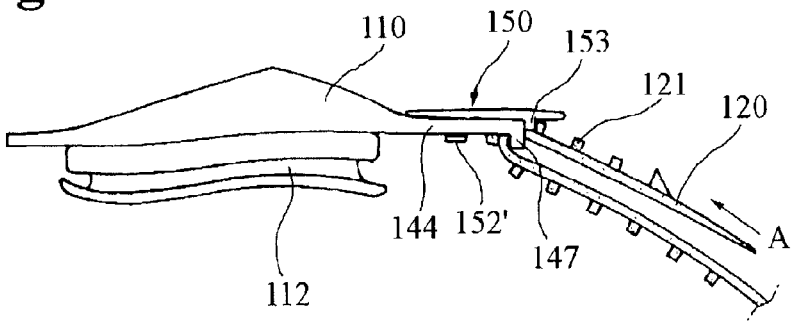
FIGS. 13A and 13B are side views of the portion of the swimming goggles shown in FIG. 9, depicting operation of the buckle assembly.
Figure 13B:
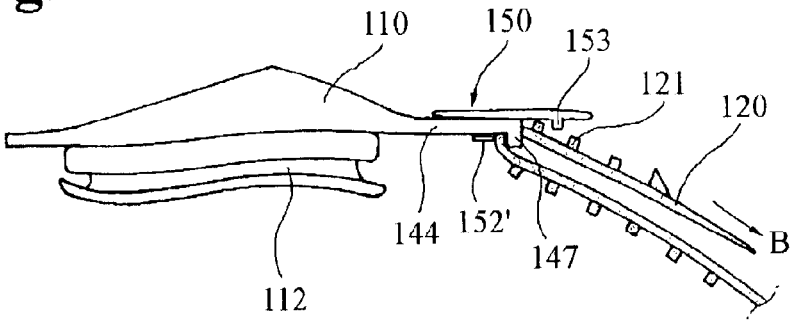
Figure 14A:
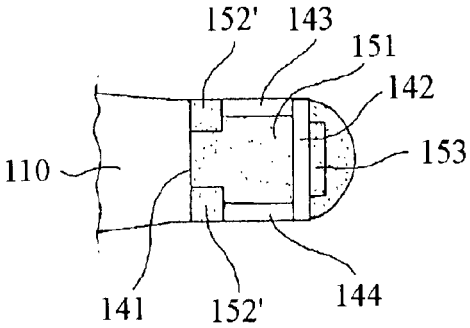
FIGS. 14A and 14B are bottom views showing the relative displacement of the slider for the buckle body of the buckle assembly shown in FIG. 9.
Figure 14B:
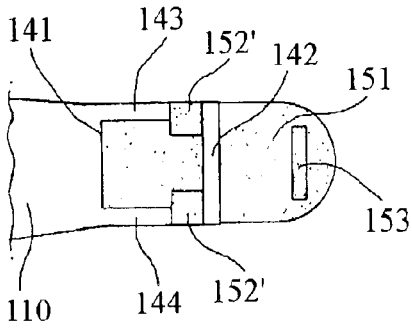

Further, hook pieces 152' in the slider of FIG. 12, extend perpendicularly from a position inwardly spaced by one thickness from the opposing edges of slider body 151 as shown. In the buckle assembly of FIG. 3, first stoppers 146 have to be individually formed on first side 141, whereas in the buckle assembly of FIG. 9, the inner portion of first side 141 acts as the first stoppers because hook pieces 152' are bent from the inside to the outside and connected to the inside of the rectangular frame 145 of the buckle body 140.

Second Embodiment

Figure 15:
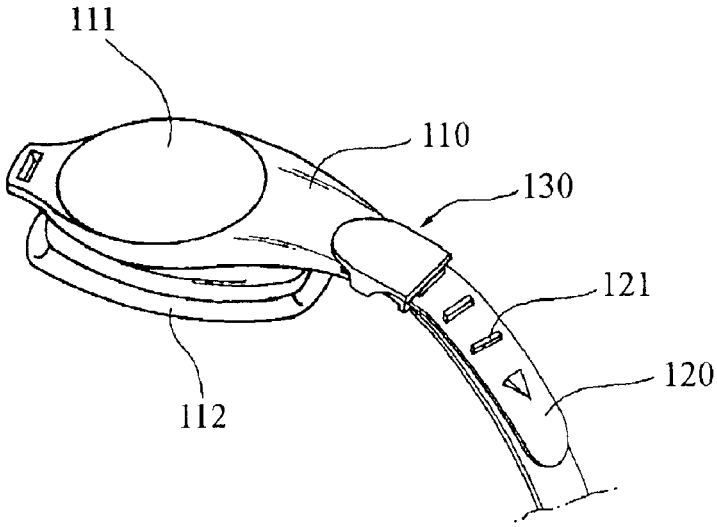
FIG. 15 is a perspective view showing one lens frame of a swimming goggles having a buckle assembly in accordance with a second embodiment of the present invention.
Figure 16:
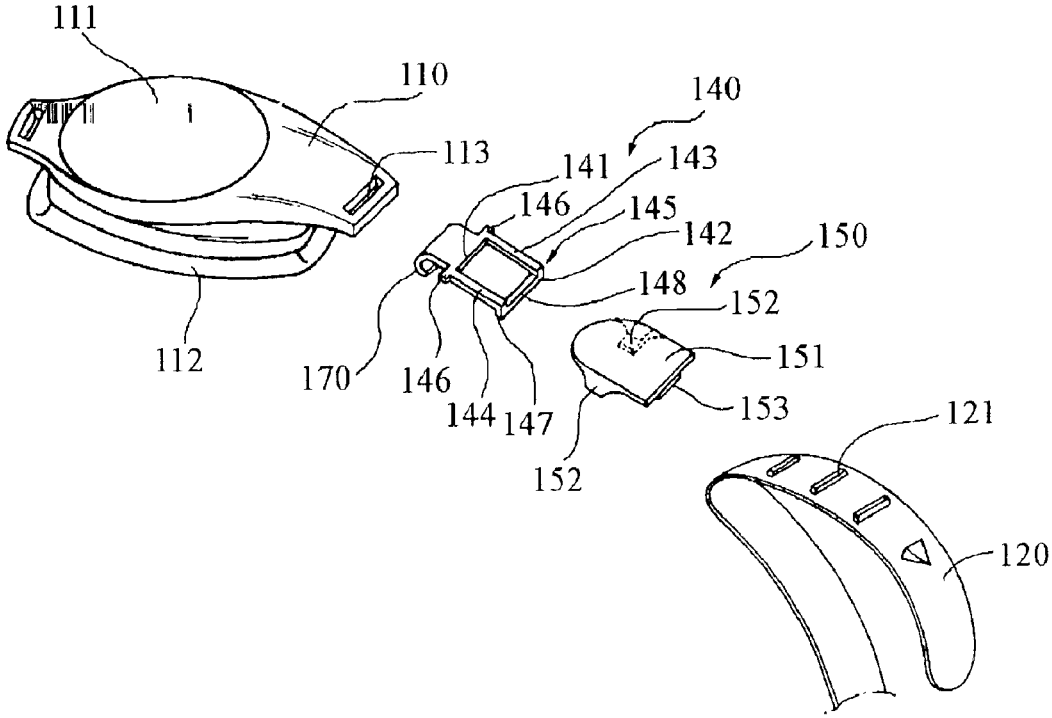
FIG. 16 is an exploded perspective view showing components of the swimming goggles shown in FIG. 15.

FIGS. 15 and 16 are a partial perspective view and an exploded perspective view showing the swimming goggles having a buckle assembly in accordance with a second embodiment of the present invention.

While each buckle body in the first embodiment is integrally formed with a lens frame, the buckle body in the second embodiment is individually formed independent of a lens frame. Except for this, the constitution and operation of second embodiment are the same as in the first embodiment.

Referring to FIGS. 15 and 16, a connecting member 170 for connection with the lens frame is formed on first side 141 of rectangular frame 145 of the buckle body 140. The connecting member 170 for connection with lens frame can be a hook means as illustrated in FIG. 16 or the like. An aperture 113 is formed on the lateral side of lens frame 110 in order to accommodate connecting member 170 of buckle body 140. The width of aperture 113 formed in the lens frame is larger than the thickness of connecting member 170. When the swimming goggles are worn, flexible band 120 pulls on connecting member 170 and provides a biasing force which prevents disengagement from aperture 113.

Figure 17:
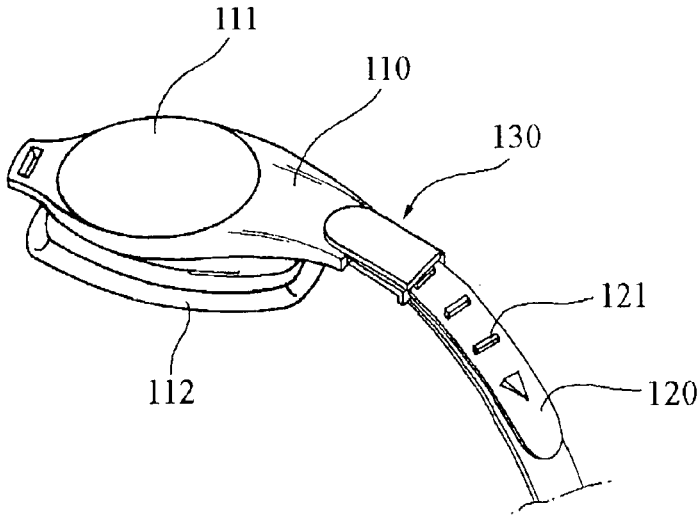
FIG. 17 is a perspective view showing a variation on the buckle assembly shown in FIG. 15.
Figure 18:
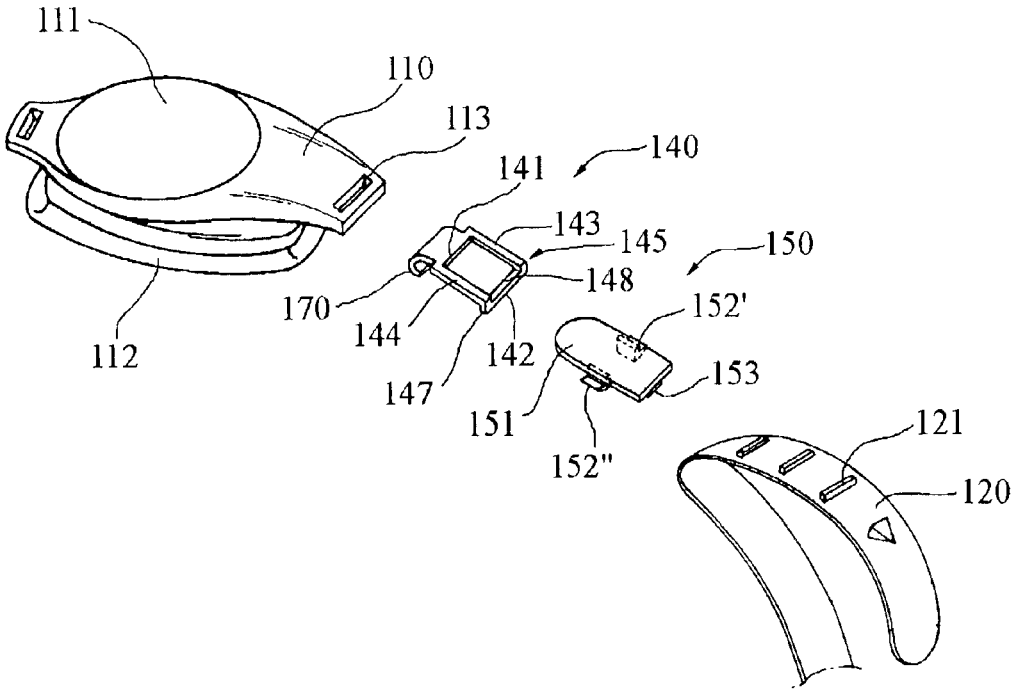
FIG. 18 is an exploded perspective view showing components of the swimming goggles shown in FIG. 17.

FIGS. 17 and 18 show a variant to the second embodiment buckle assembly depicted in FIG. 15. The buckle assembly of FIG. 17 is different with the buckle assembly of FIG. 15 in the configuration of the hook pieces of the slider and first stoppers of the buckle body. The hook pieces of the slider and the buckle body have the same configurations with that of the apparatus shown in FIG. 9.

Third Embodiment

Figure 19:
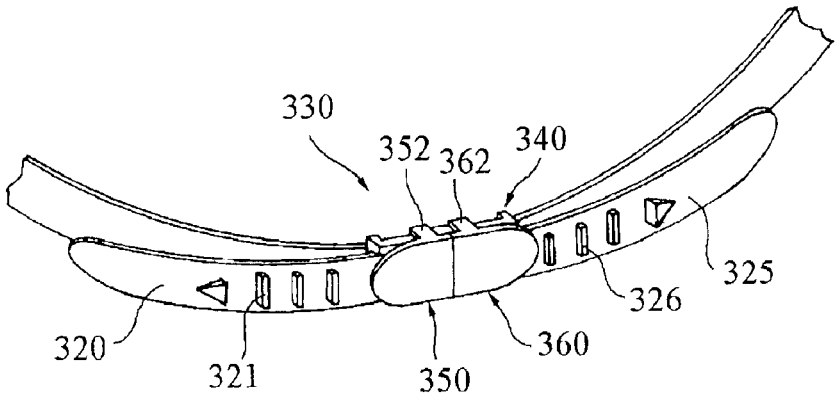
FIG. 19 is a perspective view showing a buckle assembly combining flexible bands in accordance with a third embodiment of the present invention.
Figure 20:
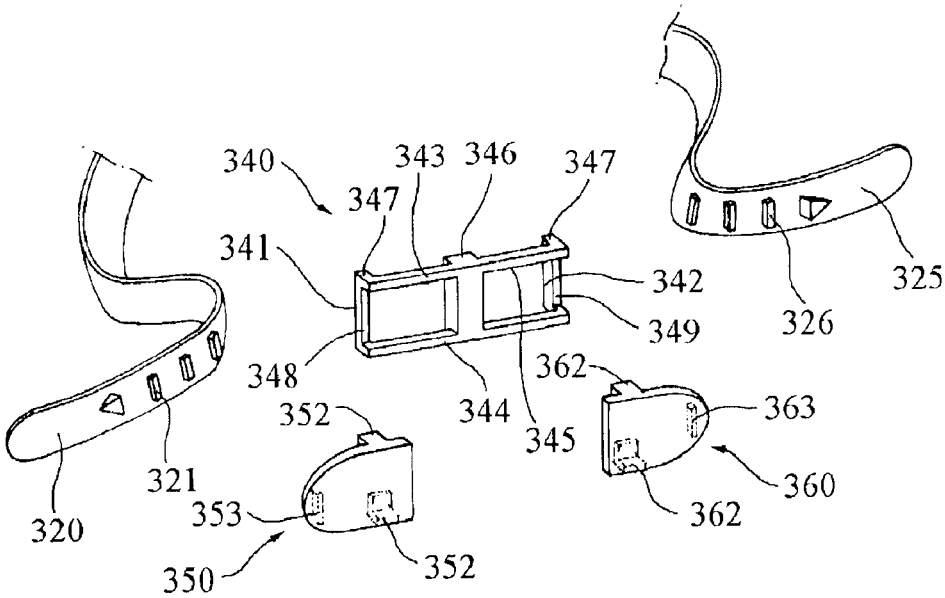
FIG. 20 is an exploded perspective view showing components of the buckle assembly shown in FIG. 19.

FIGS. 19 and 20 are a perspective view and an exploded perspective view showing a buckle assembly with combined flexible bands in accordance with a third embodiment of the present invention.

As shown in FIG. 19, the buckle assembly 330 comprises an individually formed buckle body 340, first slider 350 and second slider 360. FIG. 20 shows that buckle body 340 comprises a rectangular frame 345 having first side 341 and second side 342 which are parallel with each other and third side 343 and fourth side 344 which are parallel with each other. First stopper 346 is formed on the center of third side 343 and fourth side 344 of the rectangular frame 345 and second stoppers 347 are formed on first side 341 and second side 342 of the rectangular frames 345, respectively. First band support portion 348 is integrally formed at first side 341. First flexible band 320 having a plurality of stop members 321 is wound on first band support portion 348. Second band support portion 349 is integrally formed at second side 342. Second flexible band 325 having a plurality of stop members 326 is wound on second band support portion 349.

First stopper 346 is a portion extending perpendicularly from the centers of the third side 343 and fourth side 344. Second stoppers 347, first side 348 and second side 349 are the same configuration as their respective counterparts shown in the first embodiment depicted in FIG. 5.

First slider 350 and second slider 360 are in the same configuration as the slider of the first embodiment shown in FIG. 6. FIG. 20 shows that first slider 350 comprise first hook pieces 352 and first band pressing piece 353; and second slider 360 comprises second hook pieces 362, and second band pressing piece 363. Therefore, the connection between the buckle body 340 and the slider 350 and their relationships with a flexible band are very similar with the above-described first embodiment. They are different in that two flexible bands 320, 325 are respectively wound on first and second band support portions 348, 349 of the individual ends of the buckle assembly, and the buckle assembly is located at the posterior of a user's head.

When a user wishes to adjust the length of the flexible bands 320, 325, the bands are adjustably released by pulling each free ends of first and second flexible band 320, 325 which are wound on the buckle assembly 330 located at the rear of the user's head. Details of the movement of the sliders against the buckle body is not repeated as the relation of the position for the buckle body in terms of pulling and release are the same as for the first embodiment, described hereinabove.

Figure 21:
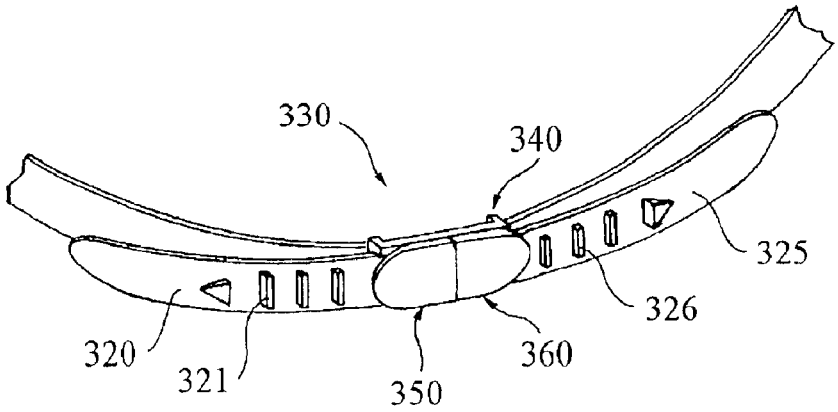
FIG. 21 is a perspective view showing a variation of the buckle assembly shown in FIG. 19.
Figure 22:
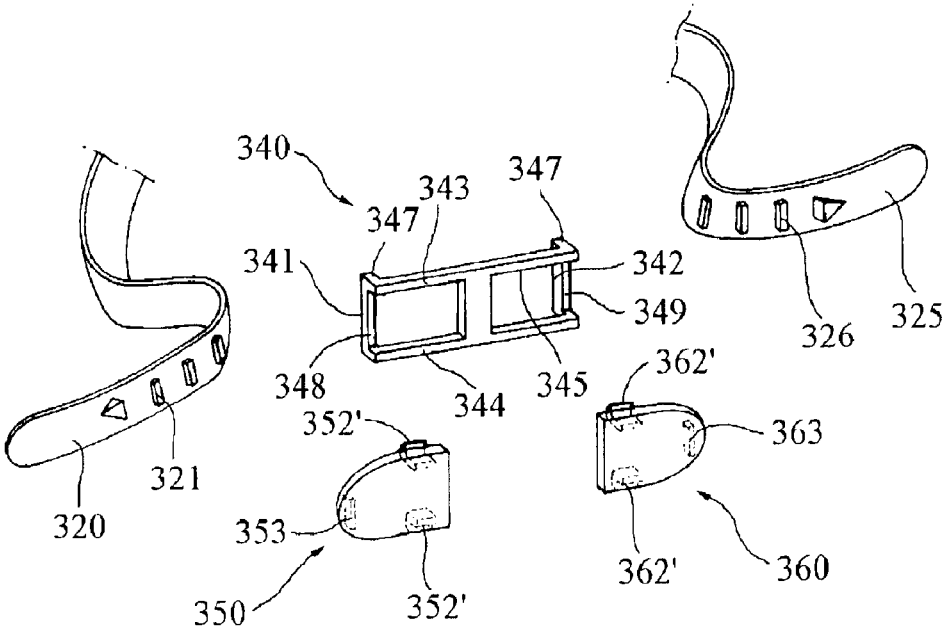
FIG. 22 is an exploded perspective view showing components of the buckle assembly shown in FIG. 21.

FIG. 21 shows a variant of the buckle assembly illustrated in FIG. 19. When the buckle assembly depicted in FIG. 19 is compared to the buckle assembly of FIG. 21, the notable difference is in the configurations of the hook pieces of the respective sliders and the first stopper on the buckle bodies. The hook pieces of the slider and first stopper on the buckle body of the variant shown in FIG. 22 are the same configurations as those described with reference to FIG. 10.

Fourth Embodiment

Figure 23:
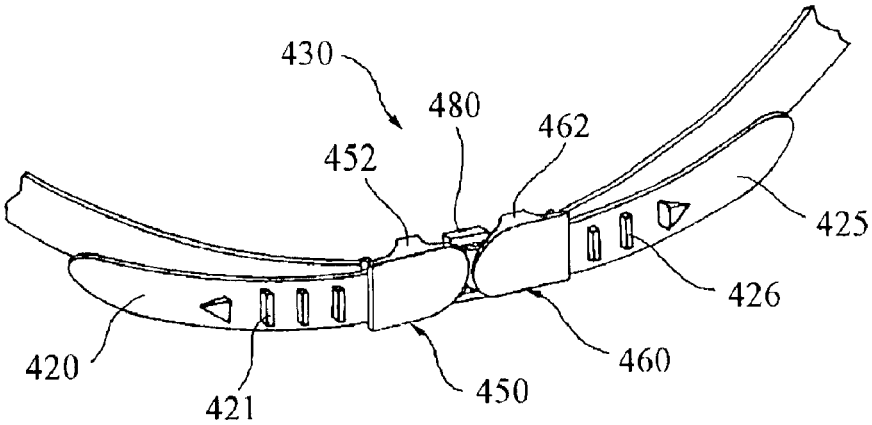
FIG. 23 is a perspective view showing a buckle assembly combining flexible bands in accordance with a fourth embodiment of the present invention.
Figure 24:
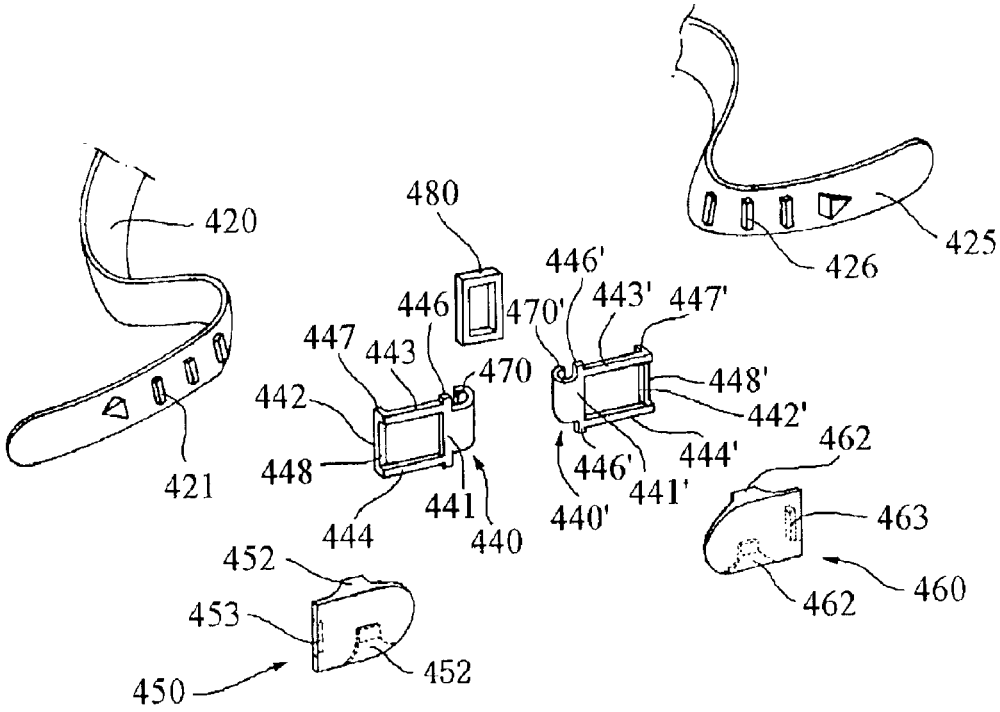
FIG. 24 is an exploded perspective view showing components of the buckle assembly shown in FIG. 23.

FIGS. 23 and 24 are a perspective view and an exploded perspective view showing a buckle assembly combining flexible bands in accordance with a fourth embodiment of the present invention.

The fourth embodiment is a buckle assembly in which two buckle assemblies of the second embodiment are connected to each other by using a connector. Buckle assembly 430 comprises first and second buckle bodies 440, 440', first and second sliders 450, 450', and a connector 480.

First and second buckle bodies 440, 440' comprise rectangular frames having first sides 441, 441', second sides 442, 442', third sides 443, 443' and fourth sides 444, 444', and first and second band support portions 448, 448'. First and second sliders 450, 460 comprise first hook pieces 452 and second hook pieces 462, and first and second band pressing pieces 453, 463, respectively. First and second flexible bands 420, 425 having a plurality of stop members 426 are wound on first and second band support portions 448, 448'.

The two buckle assemblies 440, 440' are connected to each other by inserting first and second connecting members 470, 470' respectively formed on first and second buckle bodies into the connector 480. First and second connecting members 470, 470' can be in the form of hook means or the like. The shape of connector 480 is shown as rectangular in the drawings, however, one skilled in the art will be able to substitute other shapes with equal efficacy after having the benefit of this disclosure.

The adjustments to the length of the flexible bands, the movement of the sliders for the buckle bodies and the relations of the positions for the buckle bodies according to the pulling bias or release of the pulling bias is not repeated here as they are individually the same as with the above-described embodiments.

Figure 25:
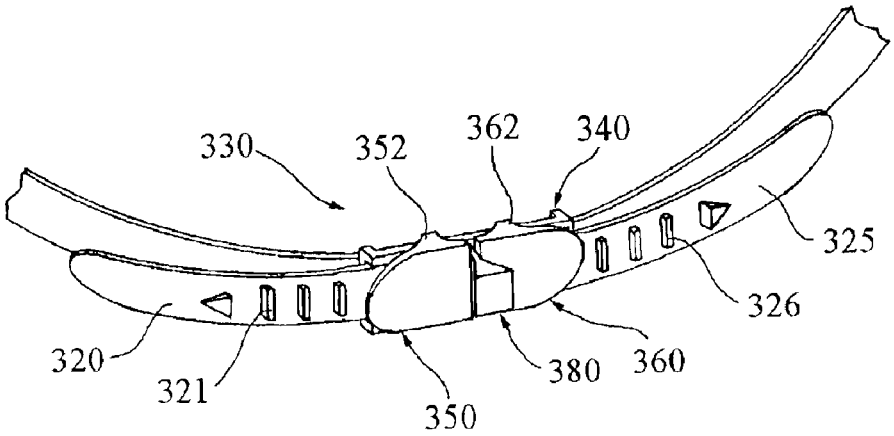
FIG. 25 is a perspective view showing a buckle assembly combining flexible bands, further comprising a slot and a pusher in the third embodiment of the present invention.
Figure 26:
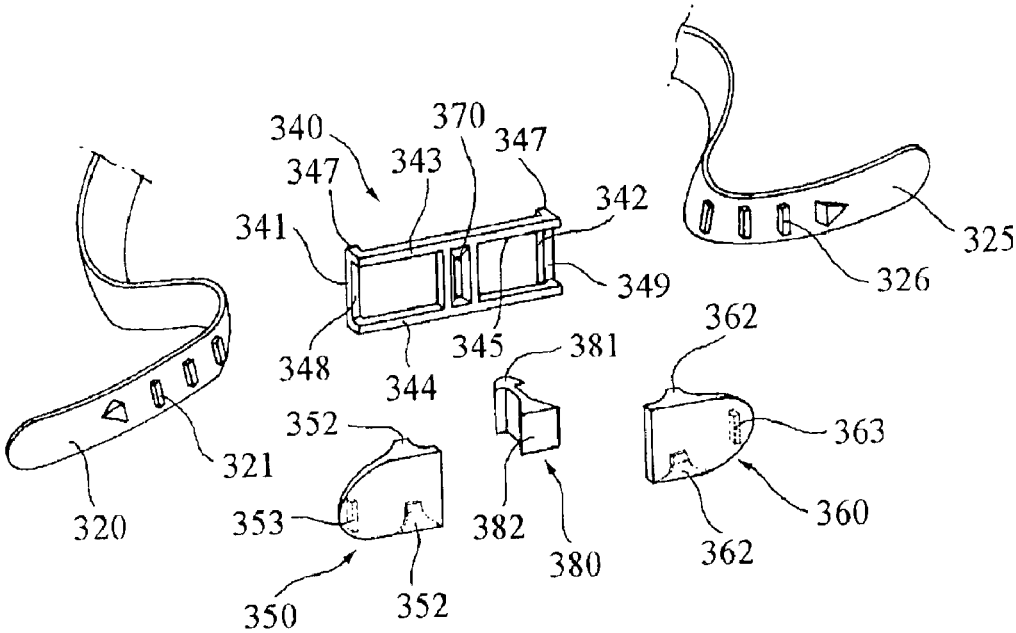
FIG. 26 is an exploded perspective view showing components of the buckle assembly shown in FIG. 25.

FIGS. 25 and 26 are a perspective view and an exploded perspective view showing a buckle assembly combining flexible bands, and further comprising a slot and a pusher in addition to the third embodiment of the present invention as depicted in FIGS. 19 and 20.

FIG. 26 illustrates slot 370 as having a taper such that its upper width is larger than the lower width at its bottom apex. Slot 370 is formed on the connecting portion which connects the centers of third side 343 and fourth side 344. FIG. 26 also illustrates a pusher 380 which is made in a shape that corresponds to the slot shape of slot 370, and forms a two-edged hook projection 381 at its insertion end. Thus, pusher 380 comprises a hook projection 381 at one end and an upper portion 382 at the opposite end. Hook projection 381 is inserted and fixed through slot 370. When pusher 380 is brought adjacent slot 370, a user can easily release the flexible bands upon demand as upper portion 382 is formed to respectively push first and second sliders 350, 360 to second positions.

The abovementioned embodiments have been described with flexible bands having a plurality of stop members longitudinally disposed along the flexible band, as slidable, moving and stopping element for the slider, and preferably comprised of a plurality of widthwise ridges as shown on the drawings. Alternatively, a plurality of widthwise through-holes, widthwise rectangular recesses or the like may be formed on the flexible bands so that a band pressing piece can be inserted into them, thereby holding the flexible band on the buckle assembly in the adjusted condition. In this case, as there are no the widthwise ridges on the flexible band, pressure by the widthwise ridges on a users head may be avoided for sensitive users.

While several exemplary forms of the invention have been illustrated in the accompanying drawings and described above, other modifications will become apparent to those skilled in the art after having the benefit of this disclosure.

As described above, the buckle assembly for adjusting flexible bands in accordance with the present invention allow a user to easily and quickly adjust the length of the band with one hand while wearing the swimming goggles in operation.

What is claimed is:

1. A buckle assembly for adjusting the length of a flexible band of swimming goggles, comprising:

a) a buckle body further comprised of a band support portion onto which a flexible band having a plurality of stop members longitudinally disposed along said band, is wound; and b) a slider connected to said buckle body for slidably moving between a first position and a second position with respect to said band support portion, said slider having a band pressing piece which presses and holds the flexible band against said band support portion at said first position, thereby one of said flexible band stop members being stopped by said band pressing piece and said slider being moved to said second position when said flexible band is extended by being pulled, and another of said flexible band stop members being stopped by said band pressing piece and said slider being moved to said first position when said flexible band contracts by being released from pulling;

wherein said buckle body comprises a rectangular frame having a first side and a second side which are parallel with each other and a third side and a fourth side which are parallel with each other, a first stopper formed on said first side of said rectangular frame to set said first position of said slider, and a second stopper formed on said second side of said rectangular frame to set said second position of said slider; and wherein said slider comprises a pair of hook pieces which are slidably connected to said buckle body on said third and fourth sides and stopped at said first position and said second position by said first stopper and said second stopper, respectively.

2. Swimming goggles comprising a pair of lens frames including lenses, a flexible band having a plurality of stop members longitudinally disposed along said band, and at least one buckle assembly of claim 1 combining said lens frame and said flexible band;

wherein said buckle body is integrally formed with said lens frame.

3. The buckle assembly of claim 1, wherein said stopper members are a plurality of widthwise ridges longitudinally disposed along said flexible band.

4. The buckle assembly of claim 1, wherein said stopper members are a plurality of widthwise through-holes longitudinally disposed along said flexible band.

5. The buckle assembly of claim 1, wherein said stopper members are a plurality of widthwise recesses longitudinally disposed along said flexible band.

* * * * *